US007709035B2

(12) United States Patent
Richardson et al.

(10) Patent No.: US 7,709,035 B2
(45) Date of Patent: May 4, 2010

(54) SELF-HEATING, SELF-HYDRATING POUCH TO SIMULTANEOUSLY HYDRATE AND HEAT COMPLETELY OR PARTIALLY DEHYDRATED FOOD OR BEVERAGE PRODUCTS IN SAID POUCH

(75) Inventors: Michelle Richardson, Providence, RI (US); Tom C. S. Yang, Wayland, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 672 days.

(21) Appl. No.: 11/726,861

(22) Filed: Mar. 23, 2007

(65) Prior Publication Data

US 2008/0230046 A1 Sep. 25, 2008

(51) Int. Cl.

| | |
|---|---|
| ***B65D 77/00*** | (2006.01) |
| ***B65D 81/00*** | (2006.01) |
| ***B65D 81/18*** | (2006.01) |
| ***B65D 85/00*** | (2006.01) |

(52) U.S. Cl. ..... 426/109; 126/263.08; 426/106; 426/108; 426/132

(58) Field of Classification Search ..... 426/109, 426/106, 108, 132; 126/263.08
See application file for complete search history.

(56) References Cited

U.S. PATENT DOCUMENTS

| | | | |
|---|---|---|---|
| 4,762,113 | A | 8/1988 | Hamasaki |
| 4,895,135 | A | 1/1990 | Hamasaki |
| 5,117,809 | A | 6/1992 | Scaringe |
| 5,220,909 | A | 6/1993 | Pickard |
| 5,465,707 | A | 11/1995 | Fulcher |
| 5,517,981 | A | 5/1996 | Taub |
| 5,611,329 | A | 3/1997 | Lamensdorf |
| 6,248,257 | B1 | 6/2001 | Bell |
| 6,289,889 | B1 | 9/2001 | Bell |
| 6,341,602 | B1 | 1/2002 | Fulcher |
| 6,644,383 | B2 | 11/2003 | Joseph |

FOREIGN PATENT DOCUMENTS

WO WO 9411682 A1 * 5/1994

* cited by examiner

*Primary Examiner*—Brent T O'Hern
(74) *Attorney, Agent, or Firm*—Vincent J. Ranucci

(57) ABSTRACT

A self-heating, self-hydrating pouch to simultaneously heat and hydrate a prepackaged, partially or completely dehydrated food or beverage product that is stored in the pouch. The pouch comprises multiple layers of material that prevent the transmission of water and gasses thereby preventing deterioration of the prepackaged food or beverage product. The pouch includes a membrane filter structure and flameless, exothermic reaction agents. The user adds potable or non-potable water to the pouch. When the water contacts the exothermic reaction agents, an exothermic reaction occurs which heats the water above 200° F. The membrane filter structure filters the heated water to remove bacteria, viruses, chemicals and by-products of the exothermic reaction. The filtered, heated water contacts the partially or completely dehydrated food product or dehydrated beverage product and simultaneously heats and hydrates the food or beverage product.

20 Claims, 3 Drawing Sheets

SELF-HEATING, SELF-HYDRATING POUCH TO SIMULTANEOUSLY HYDRATE AND HEAT COMPLETELY OR PARTIALLY DEHYDRATED FOOD OR BEVERAGE PRODUCTS IN SAID POUCH

STATEMENT OF GOVERNMENT INTEREST

The invention described herein may be manufactured and used by or for the Government of the United States of America for Governmental purposes without payment of any royalties thereon or therefore.

BACKGROUND OF THE INVENTION

1. Field of the Invention

The present invention is generally relates to self-heating, self-hydrating pouch that simultaneously hydrates and heats a partially or completely dehydrated food and beverage product in the pouch.

2. Description of the Related Art

Self-heating pouches or packages for the storage of foods and beverages are known in the art. Typically, such pouches are used by military personnel but are also used in recreational settings, e.g. mountain climbing, hiking, etc. One prior art method of heating prepackaged, shelf-stable foods is known as the Flameless Ration Heater. This technique is typically used by military personnel and is configured to heat prepackaged foods that are already hydrated. However, this method is inadequate for heating dehydrated food and beverage products. Another prior art product is known as the Trioxane Fuel Bar. This product has several disadvantages, namely, it emits a thermal signature, is time consuming, and requires the use of a metal cup that must be cleaned after each use. In a military situation, these disadvantages inhibit mobility on the battlefield.

Other prior art self-heating pouches use internal membrane filters that require a significant amount of time, e.g. several hours, to filter the water. Furthermore, even after the water was purified, the user would still have to heat food items and beverages, such as coffee and tea, for an additional 10-15 minutes.

A search of the prior art reveals several different types of self-heating pouches or packages configured for the storage of food and beverage products. U.S. Pat. No. 4,762,113 discloses a self-heating container having an inner container for holding a foodstuff. A primary water bag and an envelope containing an exothermic reaction agent are used to generate heat, and a secondary water bag provides continued hydration. U.S. Pat. No. 4,895,135 discloses a self-heating container that generates heat by hydration of an exothermic reaction agent. The container includes an outer shell, an envelope enclosing the exothermic reaction agent, a water bag filled with water for reaction with the agent, and a container body for containing a foodstuff. U.S. Pat. No. 5,117,809 discloses a flameless heater product for ready-to-heat meals. This invention comprises a heater pad that is adapted to be placed in a bag and contacted by water for heating food. A water-activated, exothermic heater material generates the heat. U.S. Pat. No. 5,220,909 discloses a self-heating individual meal module that comprises a tray having a top surface with a food receptacle tub formed therein for holding food to be heated by the module. The food is heated by an exothermic chemical heater pad. U.S. Pat. No. 5,465,707 discloses a self-heating individual meal package that comprises an outer pouch, a foodstuff pouch enclosed within much of the outer pouch, an exothermic pack located between the outer pouch and food stuff pouch and a solvent bag affixed to a trigger device (e.g. pull tab). U.S. Pat. No. 5,517,981 discloses a water-activated chemical heater with suppressed hydrogen. The chemical heater uses a chemical combination that generates heat for heating small portions of matter (e.g. consumable rations) without the simultaneous production of dihydrogen gas. U.S. Pat. No. 5,611,329 discloses a flameless heater that uses two non-woven polyester sheets that are thermally bonded together to form a number of components. Each pocket is filled with a powder mixture of a Mg—Fe alloy, NaCl, anti-foaming agents, and inert fillers. U.S. Pat. No. 6,248,257 discloses a portable heat source for warming food or beverages. A solid heat-producing composition is activated by the addition of water or an aqueous solution. The heat producing composition contains an acidic anhydride, an acidic salt, a basic anhydride or a basic salt. U.S. Pat. No. 6,289,889 discloses a self-heating flexible package that generates heat by contact of a heat-producing composition, such as calcium oxide, and an activating solution. The heater has several compartments containing a heat-producing composition and activating solution. The heater is activated by application of hand pressure to rupture a frangible seal that allows the heater components to mix. U.S. Pat. No. 6,341,602 discloses a heater pouch that provides flameless caloric heat to a food product inside a product container. The pouch has a flexible cover having a gas-permeable portion and a liquid permeable portion. The cover forms a closed cavity. Tablets of exothermic material are located in the cavity. U.S. Pat. No. 6,644,383 discloses a self-heating, self-coding package that comprises a flexible temperature changing package that can heat or cool food in the package. The package includes a temperature changing element adjacent to the food item and an offset activation point that prevents damage to the food.

What is needed is a new and improved self-heating pouch that is also self-hydrating and which can quickly heat and hydrate partially or completely dehydrated food or beverage products.

SUMMARY OF THE INVENTION

Accordingly, it is an object of the present invention to provide a self-heating, self-hydrating pouch that can quickly heat and hydrate partially or completely dehydrated prepackaged foods and beverages stored therein.

It is another object of the present invention that the pouch is non-toxic and safe to use.

It is a further object of the present invention that the self-heating, self-hydrating pouch is easy to use.

It is yet another object of the present invention that the self-heating, self-hydrating pouch is reliable.

It is yet a further object of the present invention that the self-heating, self-hydrating pouch is lightweight.

Other objects and advantages of the present invention will be apparent from the ensuing description and the accompanying drawings.

Thus, in one aspect, the present invention is directed to a self-heating, self-hydrating pouch that is configured to quickly heat and hydrate shelf-stable, dehydrated, compressed and intermediate moisture food and beverage products that are prepackaged in the pouch. In a preferred embodiment, the pouch is fabricated from laminate materials that prevent the transmission of water, and gasses thereby preventing deterioration of the prepackaged food in the pouch. The interior of the pouch includes a membrane filter and flameless, ration-heating ingredients. In accordance with the invention, the user may add potable or non-potable water to the pouch. When the water contacts the flameless, ration-heating ingredients, an exothermic reaction occurs and heats the water above 200° F. The membrane filter filters the heated water so as to remove bacteria, pathogens and chemicals. The filtered, heated water contacts the dehydrated or intermediate-moisture foods or beverages and simultaneously heats and hydrates the food or beverage product. This simultaneous heating and hydration process provides a hot, fully reconstituted, high quality food or beverage product.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawing, in which.

DESCRIPTION OF THE PREFERRED EMBODIMENTS

Figure 1:
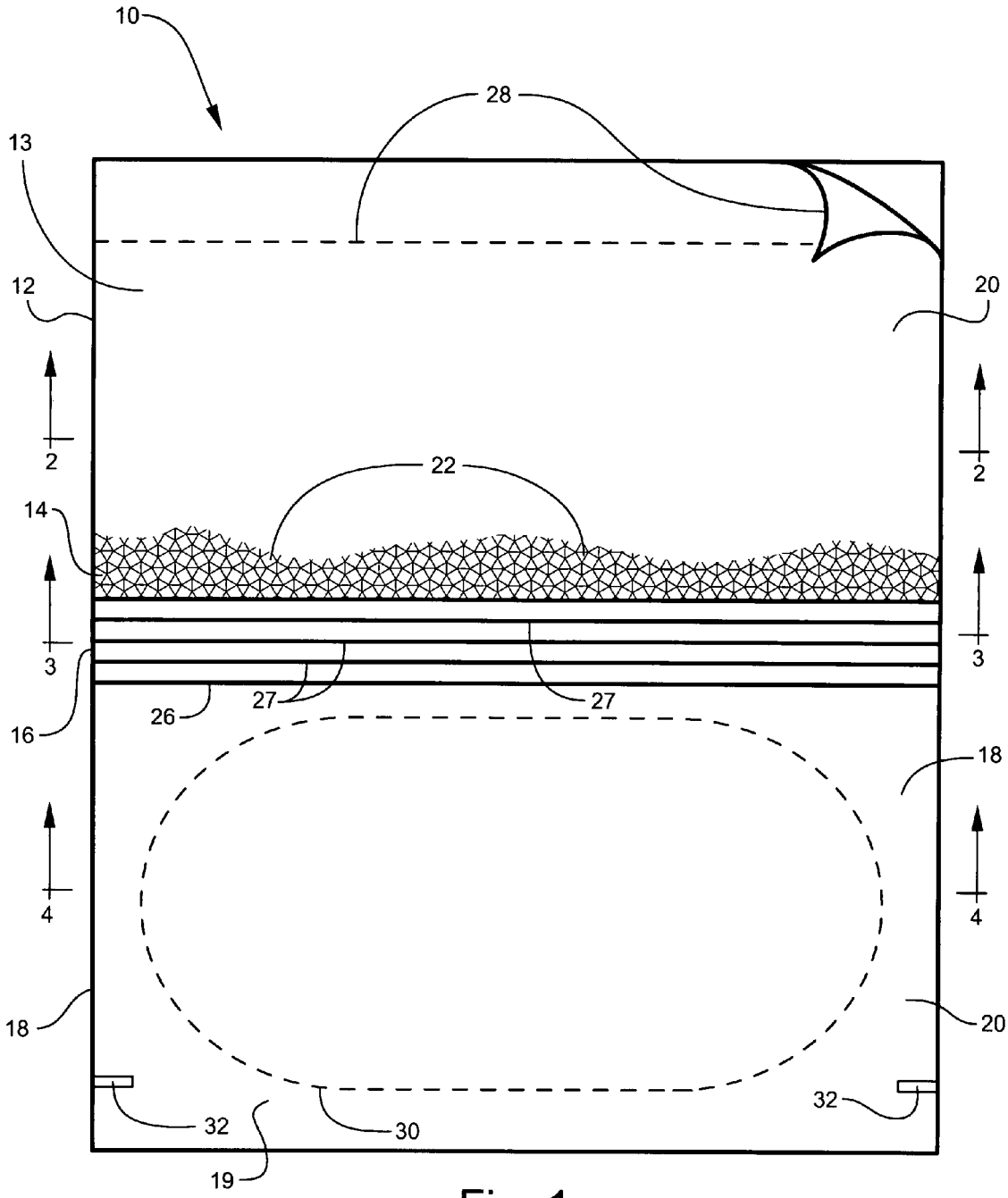
FIG. 1 is a front elevational view of the self-heating, self-hydrating pouch of the present invention.

Referring to FIG. 1, there is shown self-heating, self-hydrating pouch 10 of the present invention. Pouch 10 is configured to safely and quickly heat and hydrate shelf-stable, dehydrated, compressed and intermediate moisture food and beverage products that are prepackaged in the interior of pouch 10. Pouch 10 comprises water-receiving section 12 that has an interior 13 for receiving potable or non-potable water. Pouch 10 further includes water-heating section 14, water-filtering section 16 and product storage section 18. Product storage section 18 has an interior 19 for storing therein a dehydrated or semi-dry food or beverage product 30.

Referring to FIGS. 1-4, in a preferred embodiment, pouch 10 is fabricated from laminate materials that prevent the transmission of water and gasses thereby preventing deterioration of food or beverage product 30. In a preferred embodiment, pouch 10 comprises exterior layer 20 and inner layer 22. In a preferred embodiment, exterior layer 20 is made from polyester and inner layer 22 is made from aluminum foil. Pouch 10 also includes food contact/sealant layer 24 that is within product storage section 18 and joined to the portion of inner layer 22 that is within product storage section 18. In a preferred embodiment, food contact/sealant layer 24 is an ionomer or polyethylene film. Water-receiving section 12 includes re-sealable opening device 28 that allows a user to open water-receiving section 12 and add water to interior 13, and then close the opening to water-receiving section 12. In one embodiment, re-sealable opening device 28 is configured as a zip-loc that is known in the art and is commonly used on commercially available food storage bags. Thus, the user manipulates re-sealable opening device 28 to create access to interior 13 of water-receiving section 12 in order to pour water into interior 13. Once water is added, the user then uses re-sealable opening device 28 to close access to interior 13. Potable or non-potable water can be poured into interior 13. Preferably, the water poured into interior 13 is cold or cool.

Figure 4:
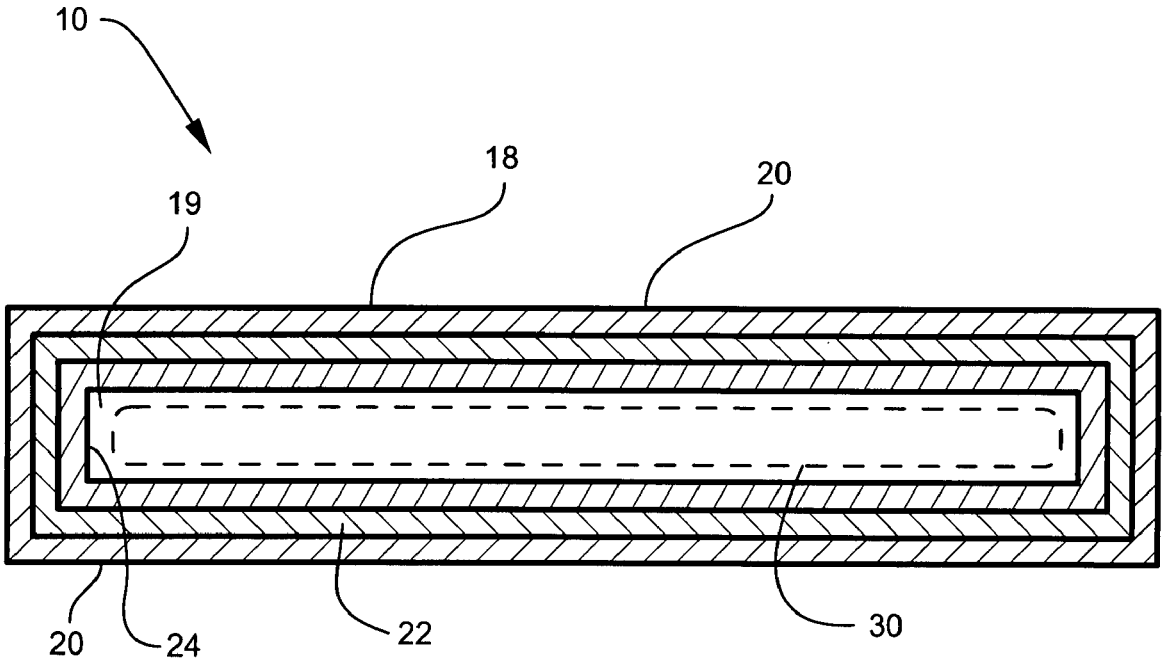
FIG. 4 is a-cross-sectional view taken along line 4-4 of FIG. 1.

Referring to FIGS. 1 and 4, food or beverage product 30 (shown in phantom) is contained within product storage section 18. Product 30 can be a food or beverage product that is in a fully or partially dehydrated state. If the product is a beverage product, the beverage product is in the form of a dry, powder. Tear-notches 32 enable a user to have access to food or beverage product 30 after it has been heated and hydrated. The use of tear-notches 32 is further explained in detail in the ensuing description.

Referring to FIG. 1, water-heating section 14 contains exothermic reaction agent 22. A flameless, exothermic reaction is produced when the water contacts exothermic reaction agent 22. In accordance with the invention, exothermic reaction agent 22 is comprised of reaction agents that provide an exothermic reaction that heats the water above 200° F. In a preferred embodiment, exothermic reaction agent 22 is in solid form, such as granules, pellets and/or powder, and comprises magnesium, a food grade iron powder and sodium. When water contacts the magnesium, magnesium hydroxide is produced thereby causing an exothermic oxidation-reduction reaction. The food-grade iron powder and sodium catalyze the exothermic reaction. In one embodiment, exothermic reaction agent 22 consists only of magnesium, the food-grade iron powder and sodium. Other exothermic reaction agents are possible.

Figure 2:
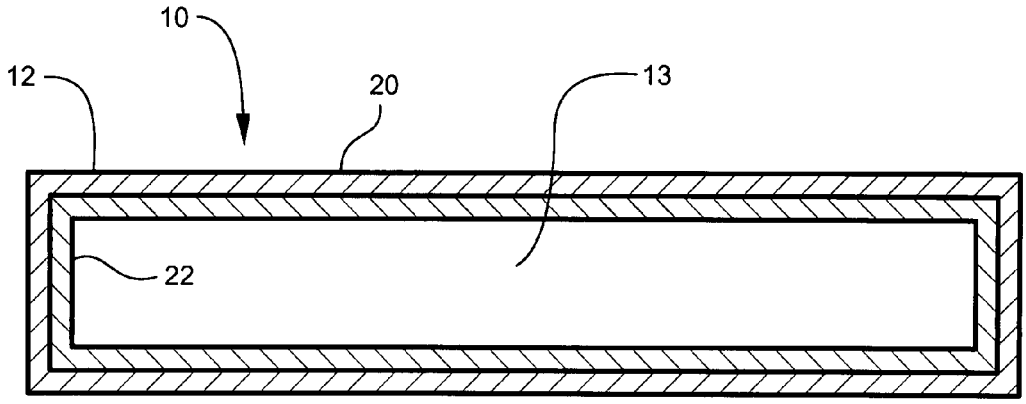
FIG. 2 is a cross-sectional view taken along line 2-2 of FIG. 1.
Figure 3:
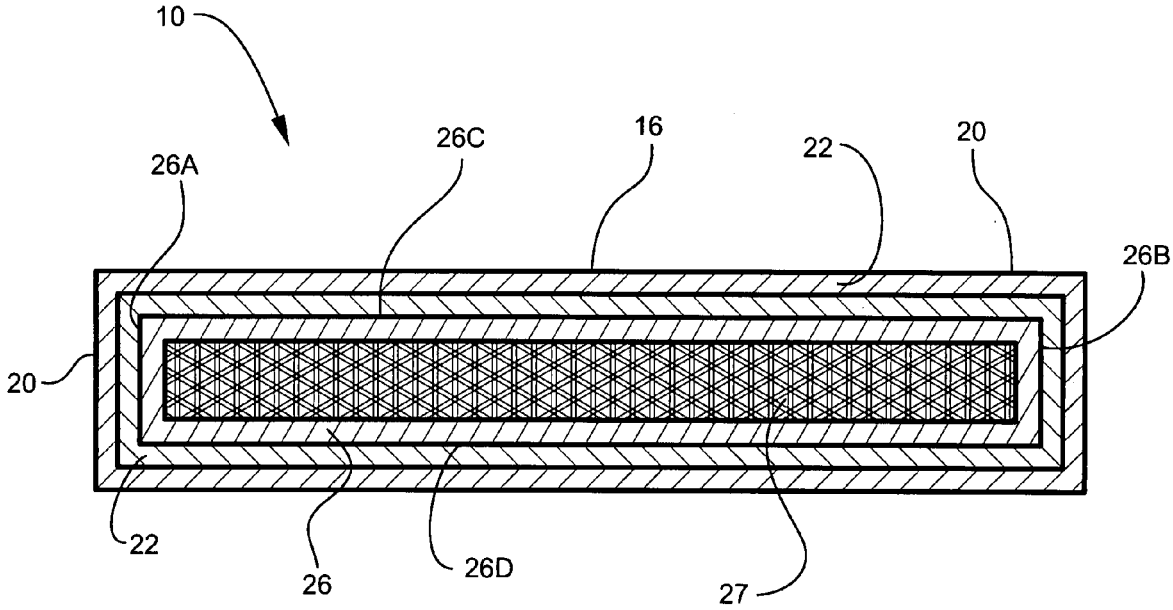
FIG. 3 is cross-sectional view taken along line 3-3 of FIG. 1.

Referring to FIGS. 1-3, water-filtering section 16 is in liquid communication with interior 13 of water-receiving section 12 and with water-heating section 14. Water-filtering section 16 comprises membrane filter structure 26 that filters the water heated by water-heating section 14. Membrane filter structure 26 has side edges 26A and 26B, front edge 26C and rear edge 26D. Each edge 26A, 26B, 26C and 26D comprises a sealant layer that is sealed to inner layer 22 so as to hold membrane filter structure 26 in place. In a preferred embodiment, the sealant layer is polyethylene. Membrane filter structure 26 comprises multiple membranes 27 that permit heated water to flow therethrough but restrict solutes such as exothermic reaction agents, exothermic reaction by-products, bacteria, viruses, pyrogens and ions. Thus, membrane filter structure 26 allows potable or non-potable water to be added into interior of water-receiving section 12. Filtered, heated water then passes through membrane filter structure 26 and into product storage section 18 where it contacts dehydrated or intermediate-moisture food or beverage product 30, and simultaneously heats and hydrates the food or beverage product 30. The simultaneous heating and hydration of food or beverage product 30 provides a hot, fully reconstituted, high quality food or beverage product. Once the filtered, heated water passes through membrane filter structure 26, membrane filter structure 26 blocks the heated, filtered water from flowing back into water-receiving section 12.

In order to use the pouch 10, the user opens water-receiving section 12 with re-sealable opening device 28 and pours either potable or non-potable water into interior 13. The water enters water-heating section 14 and contacts exothermic reaction agents 22. This results in an exothermic reaction that heats the water to at least 200° F. The heated water passes through filtering section 16 and is filtered by membrane filter structure 26. The filtered, heated water passes into product storage compartment 18 where it simultaneously heats and hydrates food or beverage product 30. The user waits for a predetermined amount of time that allows for completion of the exothermic reaction and the heating and hydration of food or beverage product 30. This predetermined amount of time varies depending upon the food or beverage product. The particular features of pouch 10, as described in the foregoing description, result in a waiting time between about 15 and 30 minutes. After this time period has elapsed, the user then holds pouch 10 upside down and tears open product storage section 18 with tear notches 32. The user may then consume the completely heated and hydrated food or beverage product.

The particular structure and configuration of membrane filter structure 26 allows the use of potable and non-potable water to hydrate and heat the food or beverage product 30. Thus, non-potable water containing pathogenic bacteria and foreign particles can be used with pouch 10. The relatively high temperature, i.e. above 200° F., achieved by water-heating section 14 decreases the hydration rate and increases the filtration rate thereby providing a preparation time between 15-30 minutes. The result is a high quality, hot food or beverage product in one step.

The self-heating, self-hydrating pouch of the present invention can be used by a variety of users in different scenarios, e.g. military personnel, first responders, hikers, campers, mountain climbers and boaters. The present invention is also suitable for use by civilians during natural disasters. Pouch 10 is relatively light in weight can be easily carried and/or stored, and can be manufactured at reasonable costs.

In military situations, the present invention provides military personnel with the advantage of being able to heat and hydrate prepackaged food and beverage products while on the move by simply adding potable or non-potable water to water-receiving section 12. The present invention provides a high quality, hot food or beverage product in significantly less time than prior art systems. The present invention substantially lessens the logistical burden of carrying large amounts of clean water on missions. Furthermore, pouch 10, and the use thereof, does not generate any significant thermal signature.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A self-heating, self-hydrating pouch that simultaneously hydrates and heats completely or partially dehydrated food or beverage products contained therein, comprising:

a water-receiving section having an interior to receive potable or non-potable water;

a heating section comprising an exothermic reaction agent that causes an exothermic reaction to occur when water in said water-receiving section contacts said exothermic reaction agent thereby heating the water wherein said exothermic reaction agent comprises magnesium; food-grade iron powder; and sodium;

a filtering section to filter the heated water; and a product storage section sized to contain therein a food or beverage product requiring hydration and heating prior to consumption and to receive filtered, heated water from said filtering section, wherein when filtered, heated water enters said product storage section, a food or beverage product contained in said product storage section is simultaneously hydrated and heated in 30 minutes or less.

2. The self-heating, self-hydrating pouch according to claim 1 wherein said filtering section comprises a membrane filter structure.

3. The self-heating, self-hydrating pouch according to claim 2 wherein said membrane filter structure comprises a plurality of membranes.

4. The self-heating, self-hydrating pouch according to claim 1 wherein said exothermic reaction agent is in solid form.

5. The self-heating, self-hydrating pouch according to claim 4 wherein said exothermic reaction agent consists of:

magnesium;

food-grade iron powder; and sodium.

6. The self-heating, self-hydrating pouch according to claim 1 wherein said pouch comprises an exterior layer and inner layer.

7. The self-heating, self-hydrating pouch according to claim 6 wherein said exterior layer is fabricated from polyester.

8. The self-heating, self-hydrating pouch according to claim 6 wherein said inner layer is fabricated from aluminium foil.

9. The self-heating, self-hydrating pouch according to claim 6 wherein said pouch further comprises a food contact/sealant layer that is located within said food storage section and joined to said inner layer therein.

10. The self-heating, self-hydrating pouch according to claim 9 wherein said food contact/sealant layer is an ionomer film.

11. The self-heating, self-hydrating pouch according to claim 9 wherein said food contact/sealant layer is a polyethylene film.

12. The self-heating, self-hydrating pouch according to claim 1 wherein said water-receiving opening includes a re-sealable opening to allow a user to pour water into said water-receiving section.

13. The self-heating, self-hydrating pouch according to claim 1 wherein said product storage section includes tear-notches to allow a user to tear open said product storage section in order to have access to a food or beverage product therein.

14. A self-heating, self-hydrating pouch that simultaneously hydrates and heats a fully or partially dehydrated food or beverage product contained therein, comprising:

a water-receiving section having an interior to receive potable or non-potable water;

a re-sealable opening in said water-receiving section to allow a user to fill said water-receiving section with water;

a heating section comprising an exothermic reaction agent that causes an exothermic reaction to occur when water in said water-receiving section contacts said exothermic reaction agent thereby heating the water wherein said exothermic reaction agent comprises magnesium; food-grade iron powder; and sodium;

a membrane filter to filter the heated water;

a product storage section sized to contain therein a food or beverage product requiring hydration and heating prior to consumption and to receive filtered, heated water from said filtering section, wherein when filtered, heated water enters said product storage section, a food or beverage product contained in said product storage section is simultaneously hydrated and heated in 30 minutes or less; and a tear-notch in said product storage section to allow a user to tear open said product storage section in order to have access to a food or beverage product in said product storage section that has been hydrated and heated.

15. The self-heating, self-hydrating pouch according to claim 14 wherein said pouch comprises an exterior layer and inner layer.

16. The self-heating, self-hydrating pouch according to claim 15 wherein said exterior layer is fabricated from polyester.

17. The self-heating, self-hydrating pouch according to claim 15 wherein said inner layer is fabricated from aluminium foil.

18. The self-heating, self-hydrating pouch according to claim 15 wherein said pouch further comprises a food contact/sealant layer that is located within said food storage section and joined to said inner layer.

19. The self-heating, self-hydrating pouch according to claim 18 wherein said food contact/sealant layer is an ionomer film.

20. The self-heating, self-hydrating pouch according to claim 18 wherein said food contact/sealant layer is polyethylene film.

* * * * *